US009857146B1

(12) United States Patent
Shelton et al.

(10) Patent No.: US 9,857,146 B1
(45) Date of Patent: Jan. 2, 2018

(54) SYSTEMS AND METHODS FOR ATTACHING A FIREARM ACCESSORY TO A FIRST RAIL SYSTEM OR A SECOND RAIL SYSTEM

(71) Applicant: RAILSCALES, LLC, Broken Arrow, OK (US)

(72) Inventors: Derek Hunter Shelton, Claremore, OK (US); Brent Taylor McGuire, Depew, OK (US)

(73) Assignee: RAILSCALES LLC, Claremore, OK (US)

( * ) Notice: Subject to any disclaimer, the term of this patent is extended or adjusted under 35 U.S.C. 154(b) by 0 days.

(21) Appl. No.: 15/196,224

(22) Filed: Jun. 29, 2016

(51) Int. Cl.
*F41A 15/00* (2006.01)
*F41G 11/00* (2006.01)
*F41C 27/00* (2006.01)

(52) U.S. Cl.
CPC ..... *F41G 11/001* (2013.01); *F41C 27/00* (2013.01)

(58) Field of Classification Search
CPC ..... F41G 11/001; F41C 27/00
USPC ..... 42/90
See application file for complete search history.

(56) References Cited

U.S. PATENT DOCUMENTS 4,959,908 A * 10/1990 Weyrauch ..... F16B 3/00 42/124
7,861,451 B1 * 1/2011 Moody ..... F41A 23/08 42/71.01
7,987,623 B1 * 8/2011 Moody ..... F41A 23/08 42/71.01
8,136,284 B2 * 3/2012 Moody ..... F41A 23/08 42/71.01
8,176,669 B1 * 5/2012 Griffin ..... F41C 23/14 42/90
8,875,434 B2 * 11/2014 Michal ..... F41C 23/16 42/90
9,429,388 B2 * 8/2016 Mayberry ..... F41C 23/16
2003/0110675 A1 * 6/2003 Garrett ..... F41C 23/02 42/85
2004/0068913 A1 * 4/2004 Solinsky ..... F41G 11/003 42/146
2004/0187374 A2 * 9/2004 Solinsky ..... F41G 11/003 42/146
2006/0037226 A1 * 2/2006 Garrett ..... F41C 23/02 42/85
2006/0156609 A1 * 7/2006 Kim ..... F41G 11/003 42/124

(Continued)

*Primary Examiner* — Samir Abdosh
(74) *Attorney, Agent, or Firm* — Eversheds Sutherland (US) LLP

(57) ABSTRACT

A rail attachment assembly for attaching a firearm accessory to a first or second rail system includes a main body comprising a first side having a protrusion configured to mate with a slot in the first rail system, a second side having a protrusion configured to mate with a slot in the second rail system, and an aperture. The rail attachment assembly also includes a cavity in the firearm accessory configured to mate with the protrusion on the first side or the second side of the main body. An aperture extends through the firearm accessory. A fastener is positionable through the aperture in the firearm accessory, the aperture in the main body, and the slot in the first rail system or the slot in the second rail system. A nut is attachable to the fastener to secure the firearm accessory to the first rail system or the second rail system.

18 Claims, 15 Drawing Sheets

(56) References Cited

U.S. PATENT DOCUMENTS

| | | | | |
|---|---|---|---|---|
| 2009/0313873 | A1* | 12/2009 | Roth | F41C 23/16<br>42/72 |
| 2011/0099878 | A1* | 5/2011 | Moody | F41A 23/08<br>42/90 |
| 2011/0167703 | A1* | 7/2011 | Deros | F41G 11/003<br>42/90 |
| 2012/0096755 | A1* | 4/2012 | Griffin | F41C 23/14<br>42/105 |
| 2012/0266514 | A1* | 10/2012 | Michal | F41C 23/16<br>42/90 |
| 2015/0013207 | A1* | 1/2015 | Bowman | F41G 11/003<br>42/111 |
| 2015/0267993 | A1* | 9/2015 | Cheng | F41C 27/00<br>42/90 |
| 2015/0316354 | A1* | 11/2015 | Cheng | F41G 11/001<br>42/90 |

* cited by examiner

SYSTEMS AND METHODS FOR ATTACHING A FIREARM ACCESSORY TO A FIRST RAIL SYSTEM OR A SECOND RAIL SYSTEM

FIELD OF THE DISCLOSURE

The disclosure generally relates to firearms and more particularly relates to systems and methods for attaching a firearm accessory to a first rail system or a second rail system.

BACKGROUND

Typical firearms may include a rail system. For example, a firearm may include an M-Lok rail system, a KeyMod rail system, or a combination thereof. The M-Lok and KeyMod rail systems are different types of open source rail system standards. Generally speaking, the M-Lok rail system includes elongated slots, and the KeyMod rail system includes keyhole slots. Due to the different configuration of the slots in the M-Lok and KeyMod rail systems, firearm accessory may not be compatible with both rail systems. That is, typical firearm accessories may be attached to one of the rail systems but not the other. Accordingly, there is a need for a rail attachment assembly that enables a firearm accessory to be attached to multiple rail systems.

SUMMARY

Some or all of the above needs and/or problems may be addressed by certain embodiments of the rail attachment assembly disclosed herein. The rail attachment assembly enables attaching a firearm accessory to a first rail system or a second rail system. The rail attachment assembly includes a main body comprising a first side having a protrusion configured to mate with a slot in the first rail system, a second side having a protrusion configured to mate with a slot in the second rail system, and an aperture. The rail attachment assembly also includes a cavity in the firearm accessory configured to mate with the protrusion on the first side of the main body or the protrusion on the second side of the main body. An aperture is disposed through the firearm accessory. A fastener is positionable through the aperture in the firearm accessory, the aperture in the main body, and the slot in the first rail system or the slot in the second rail system. A nut is attachable to the fastener to secure the firearm accessory to the first rail system or the second rail system.

Other features and aspects of the disclosure will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Described below are embodiments of a rail attachment assembly (as well as individual components of the rail attachment assembly) for attaching a firearm accessory to a first rail system or a second rail system of a firearm or multiple firearms. Methods of installing and using the rail attachment assembly on the firearm are also disclosed. The firearm may be a conventional firearm. For example, the firearm may be an M-16 style rifle, an AR-15 style rifle, an AR-10 style rifle, or an M-4 style rifle, among others. The firearm may be a pistol or a shotgun. Any firearm may be used.

The firearm may include a rail system. Any suitable rail system may be used. For example, the firearm may include an M-Lok rail system, a KeyMod rail system, or a combination thereof. The present disclosure provides the technical advantage and/or solution of providing a rail attachment assembly that is compatible with both the M-Lok and KeyMod rail systems, thereby enabling a firearm accessory to be attached to multipole rail systems on one or more firearms.

Figure 1:
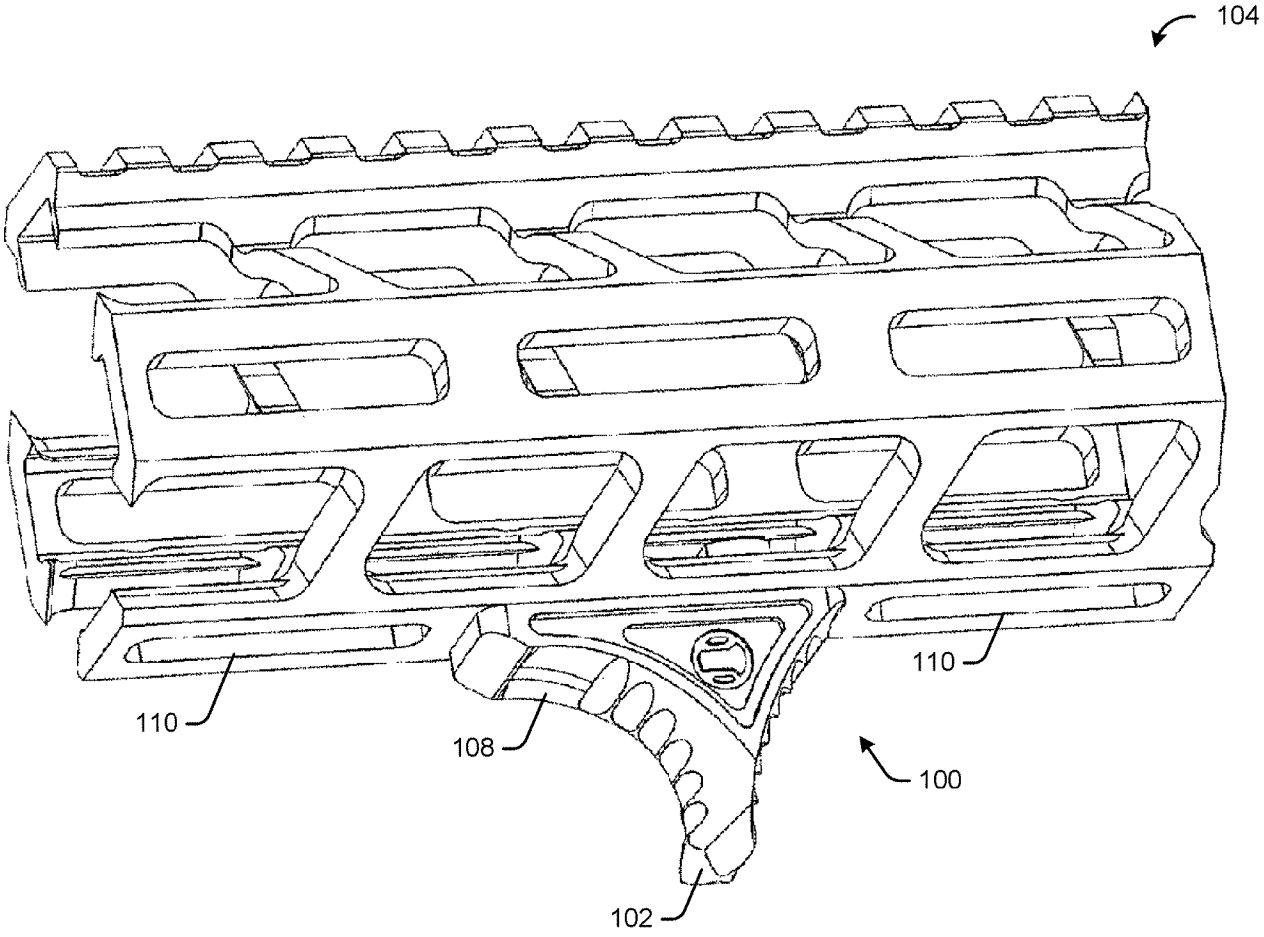
FIG. 1 depicts an upper perspective view of a rail attachment assembly in accordance with one or more embodiments of the disclosure.
Figure 2:
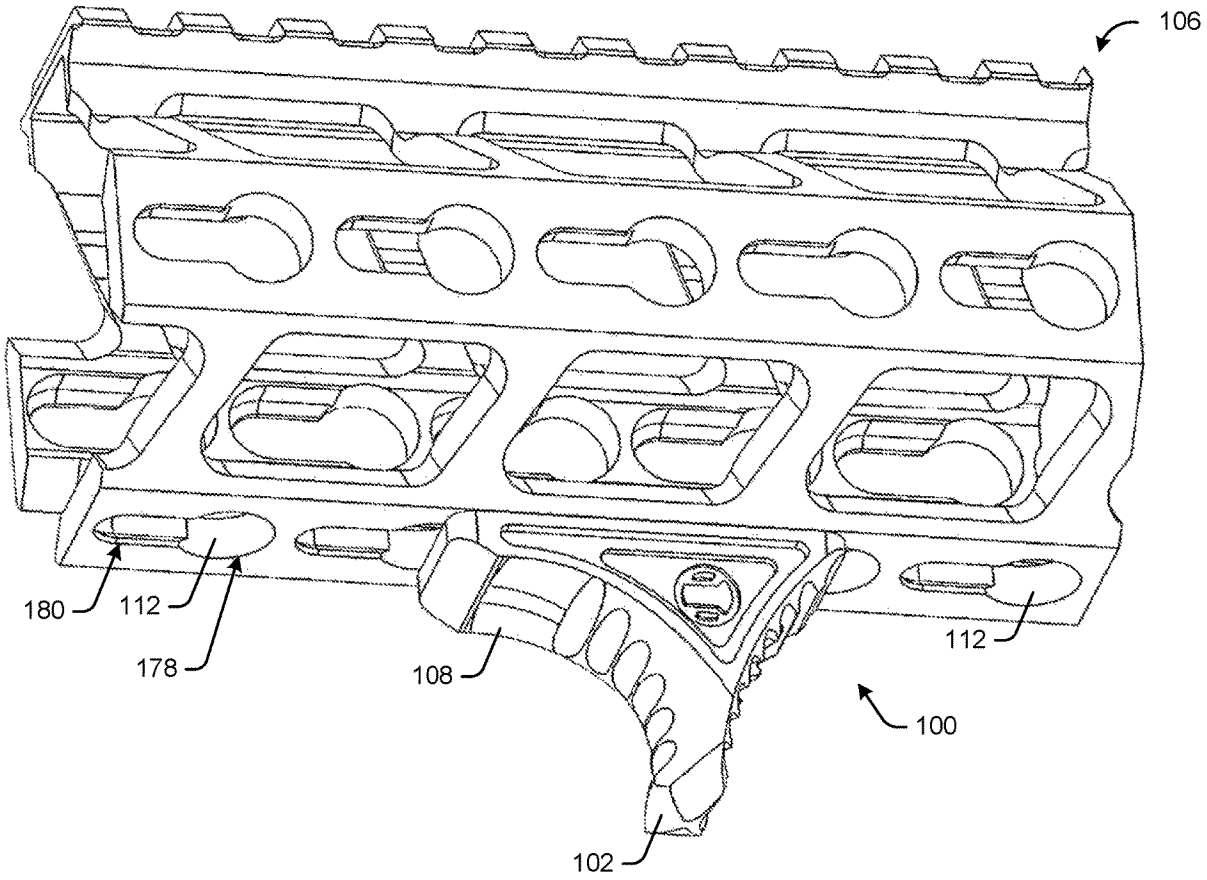
FIG. 2 depicts an upper perspective view of a rail attachment assembly in accordance with one or more embodiments of the disclosure.

FIGS. 1 and 2 depict a rail attachment assembly 100. The rail attachment assembly 100 enables the attachment of a firearm accessory 102 to a first rail system 104 or a second rail system 106. In the depicted embodiments, the firearm accessory 102 is a handstop 108. The firearm accessory 102, however, may be any suitable firearm accessory. For example, the firearm accessory 102 may be a flashlight, an optics sight, a laser sight, a bipod, a tripod, a handle, a vertical foregrip, a panel, a grenade launcher, etc. The firearm accessory 102 may be any item attachable to the rail system of a firearm. The firearm accessory 102 may be attached at any location on the first rail system 104 or the second rail system 106.

In some instances, the first rail system 104 may be an M-Lok rail system, and the second rail system 106 may be a KeyMod rail system. In this manner, as depicted in FIG. 1, the first rail system 104 may include at least one slot 110 comprising an elongated slot. The first rail system 104 may include a plurality of slots 110. Likewise, as depicted in FIG. 2, the second rail system 106 may include at least one slot 112 comprising a keyhole. The second rail system 106 may include a plurality of slots 112. The size and shape of the slot 110 in the first rail system 104 is different from the size and shape of the slot 112 in the second rail system 106. Other rail systems may be used herein.

Figure 3:
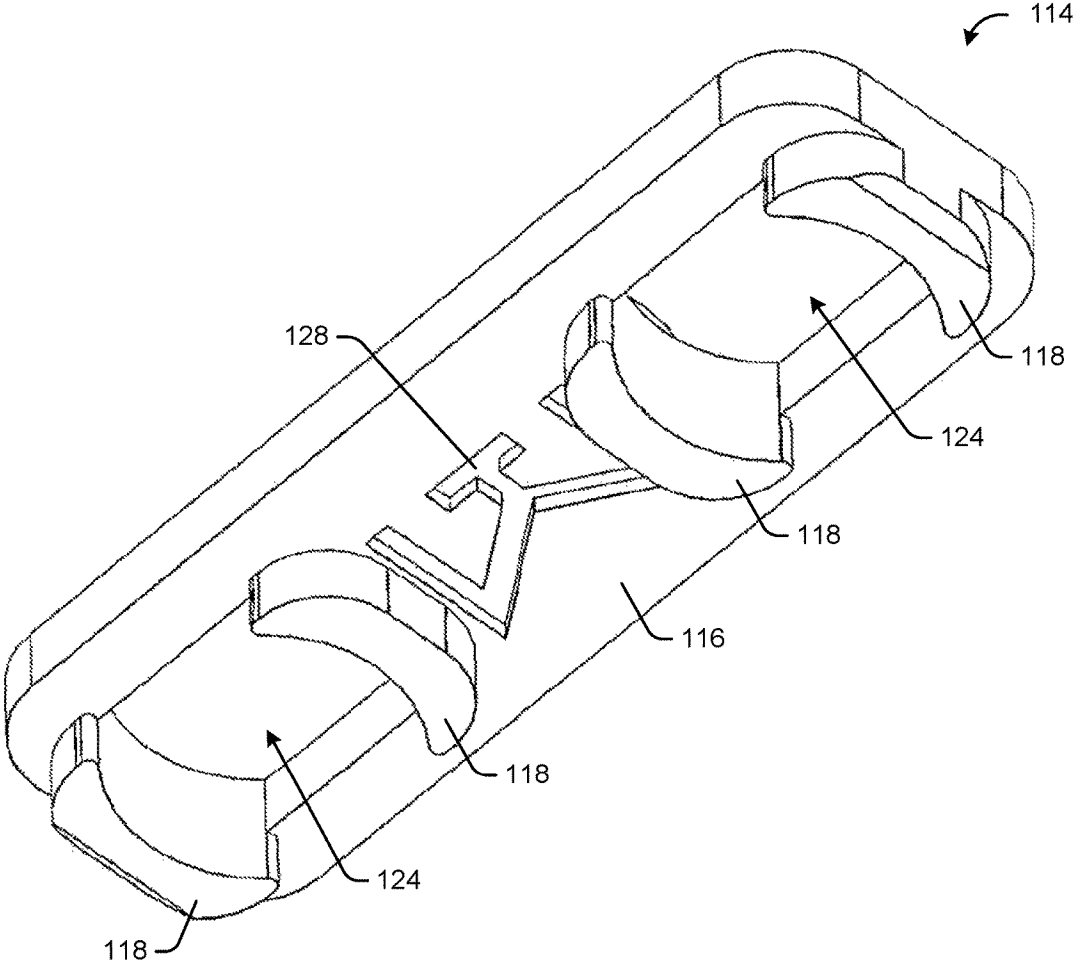
FIG. 3 depicts an upper perspective view of a main body in accordance with one or more embodiments of the disclosure.
Figure 4:
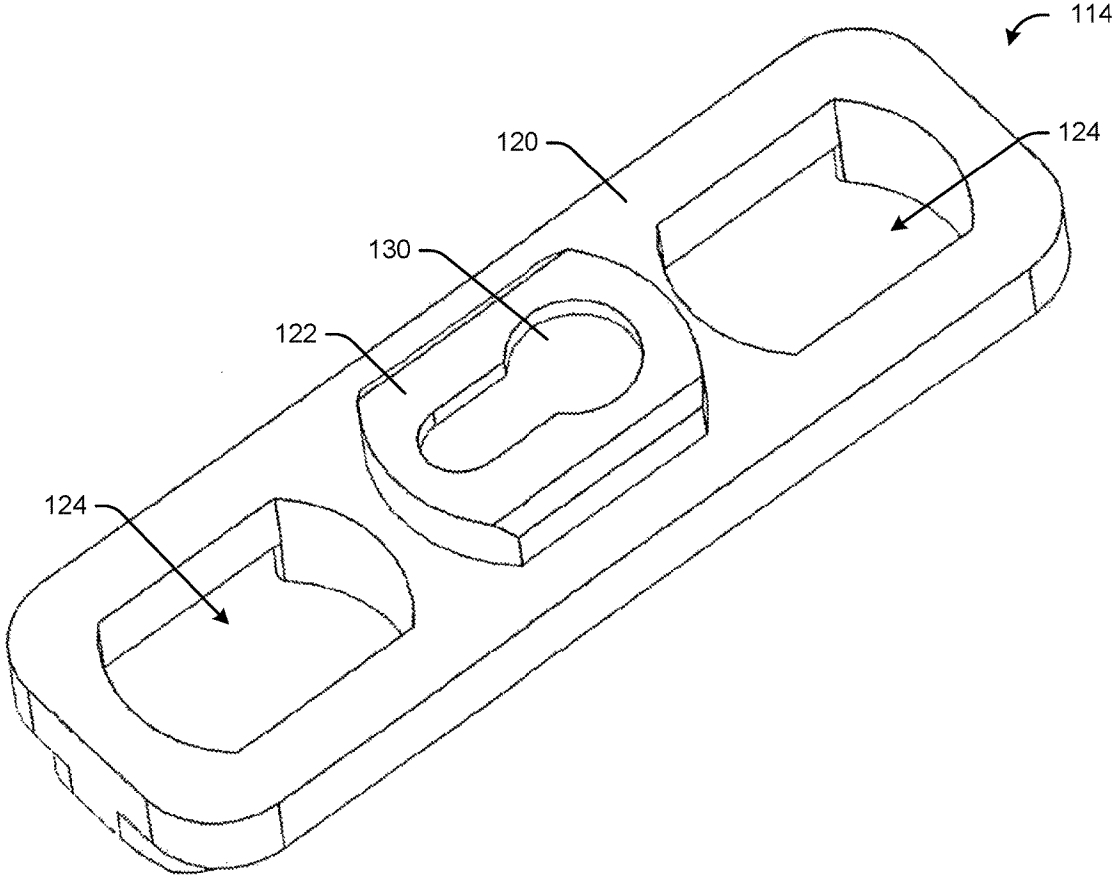
FIG. 4 depicts an upper perspective view of a main body in accordance with one or more embodiments of the disclosure.

As depicted in FIGS. 3 and 4, in order to accommodate the different configurations of the first rail system 104 and the second rail system 106, the rail attachment assembly 100 may include a main body 114. The main body 114 may include a first side 116 having a protrusion 118 configured to mate with the slot 110 in the first rail system 104, a second side 120 having a protrusion 122 configured to mate with the slot 112 in the second rail system 106, and an aperture 124. The aperture 124 may comprise a single aperture or a plurality of apertures. The protrusion 118 on the first side 116 of the main body 114 may comprise a single protrusion or a plurality of protrusion. Similarly, the protrusion 122 on the second side 120 of the main body 114 may comprise a single protrusion or a plurality of protrusion. The size and shape of the protrusion 118 on the first side 116 of the main body 114 may be different from the size and shape of the protrusion 122 on the second side 120 of the main body 114. The protrusion 118 on the first side 116 of the main body 114 and the protrusion 122 on the second side 120 of the main body 114 may be any suitable size, shape, or configuration.

Figure 5:
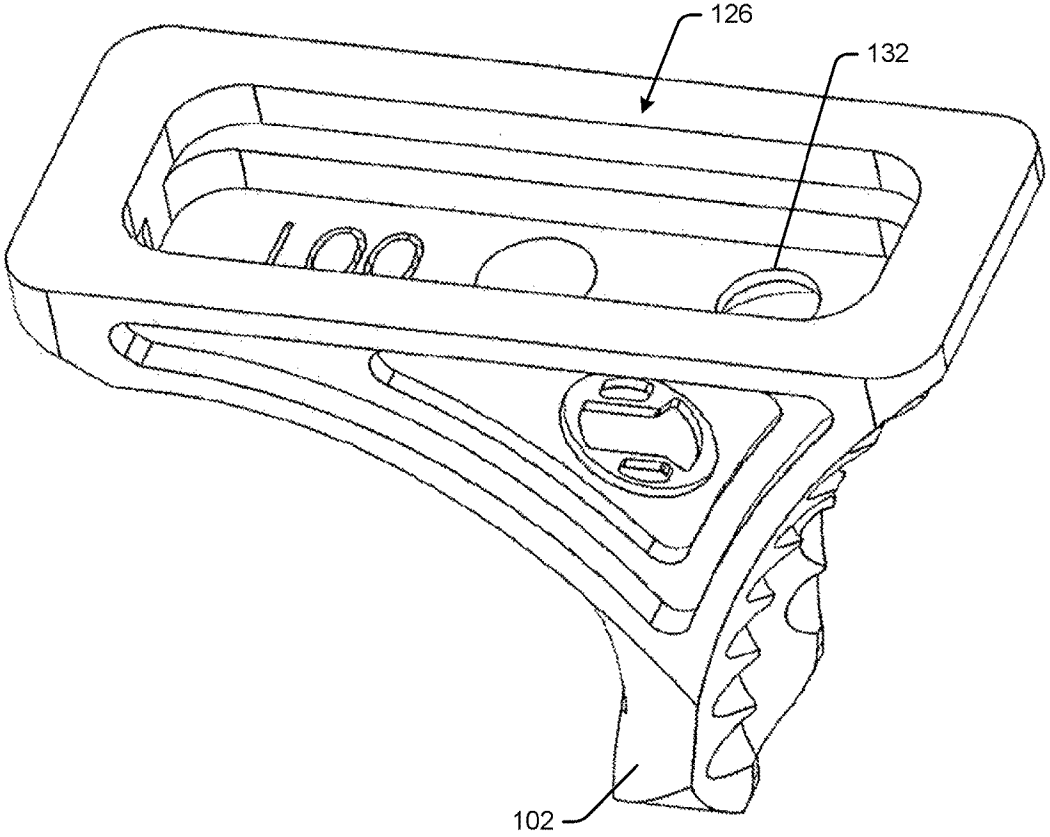
FIG. 5 depicts an upper perspective view of a firearm accessory in accordance with one or more embodiments of the disclosure.
Figure 6:
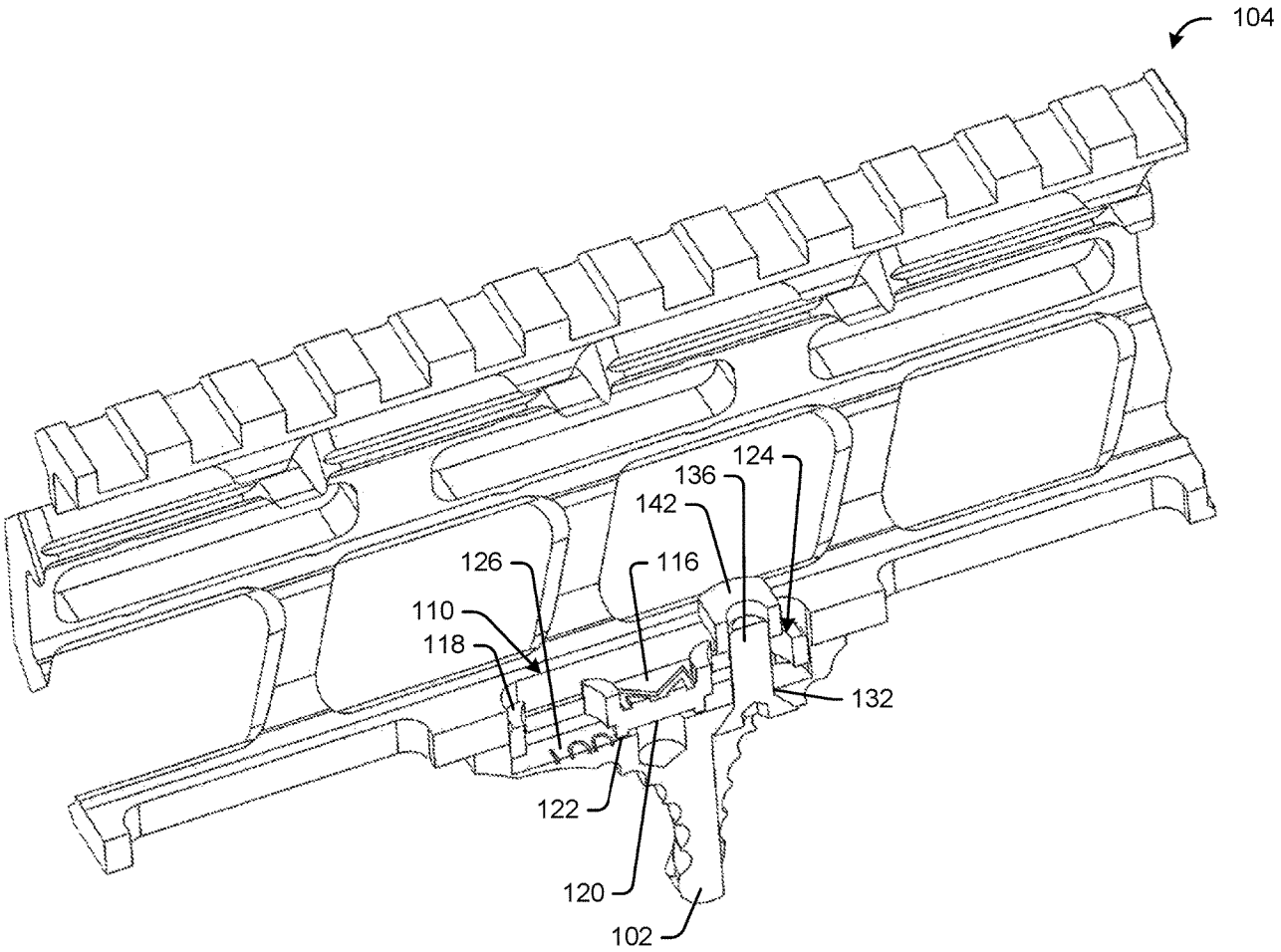
FIG. 6 depicts an upper perspective cross-sectional view of a rail attachment assembly in accordance with one or more embodiments of the disclosure.
Figure 7:
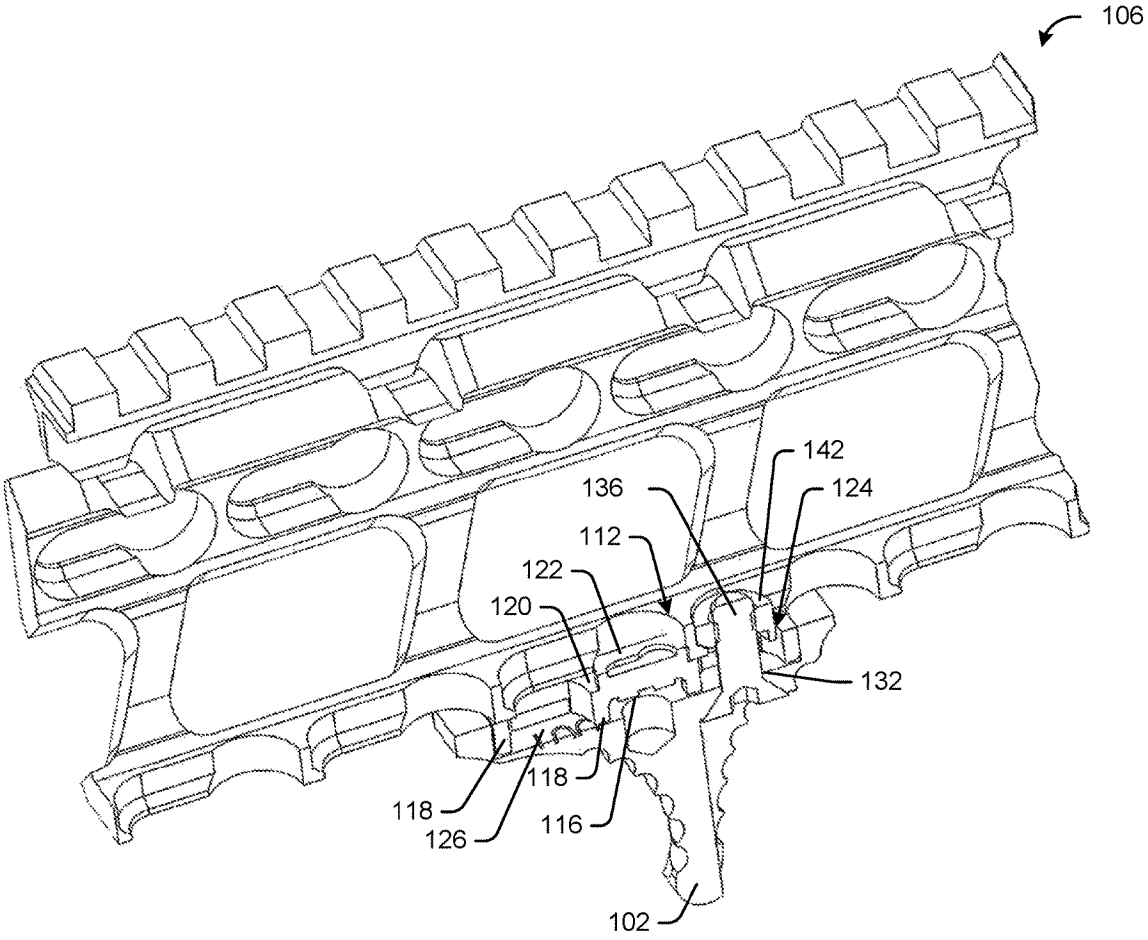
FIG. 7 depicts an upper perspective cross-sectional view of a rail attachment assembly in accordance with one or more embodiments of the disclosure.

As depicted in FIG. 5, the firearm accessory 102 may include a cavity 126. As depicted in FIGS. 6 and 7, the cavity 126 may be configured to mate with the protrusion 118 on the first side 116 of the main body 114 or the protrusion 122 on the second side 120 of the main body 114 depending on which rail system the firearm accessory 102 is to be attached. In this manner, the protrusion 118 on the first side 116 of the main body 114 or the protrusion 122 on the second side 120 of the main body 114 may nest within the cavity 126. For example, if the firearm accessory 102 is being attached to the first rail assembly 104, as depicted in FIG. 6, the protrusion 122 on the second side 120 of the main body 114 may nest within the cavity 126. Conversely, if the firearm accessory 102 is being attached to the second rail assembly 106, as depicted in FIG. 7, the protrusion 118 on the first side 116 of the main body 114 may nest within the cavity 126. In this manner, the main body 114 may be removed from the cavity 126 and rotated about its longitudinal axis and inserted back into the cavity 126 to accommodate the first rail system 104 or the second rail system 106. The cavity 126 may be any suitable size, shape, or configuration.

Referring back to FIGS. 3 and 4, in some instances, the first side 116 of the main body 114 may include a reference mark 128 indicating that the first side 116 of the main body 114 is used with the first rail system 104, and the second side 120 of the main body 114 may include a reference mark 130 indicating that the second side 120 on the main body 114 is used with the second rail system 106. The reference marking 128 on the first side 116 of the main body 114 and the reference marking 130 on the second side 120 of the main body 114 may enable a user to quickly determine the proper orientation of the main body 114 depending on which rail system the firearm accessory 102 is to be attached.

Figure 8:
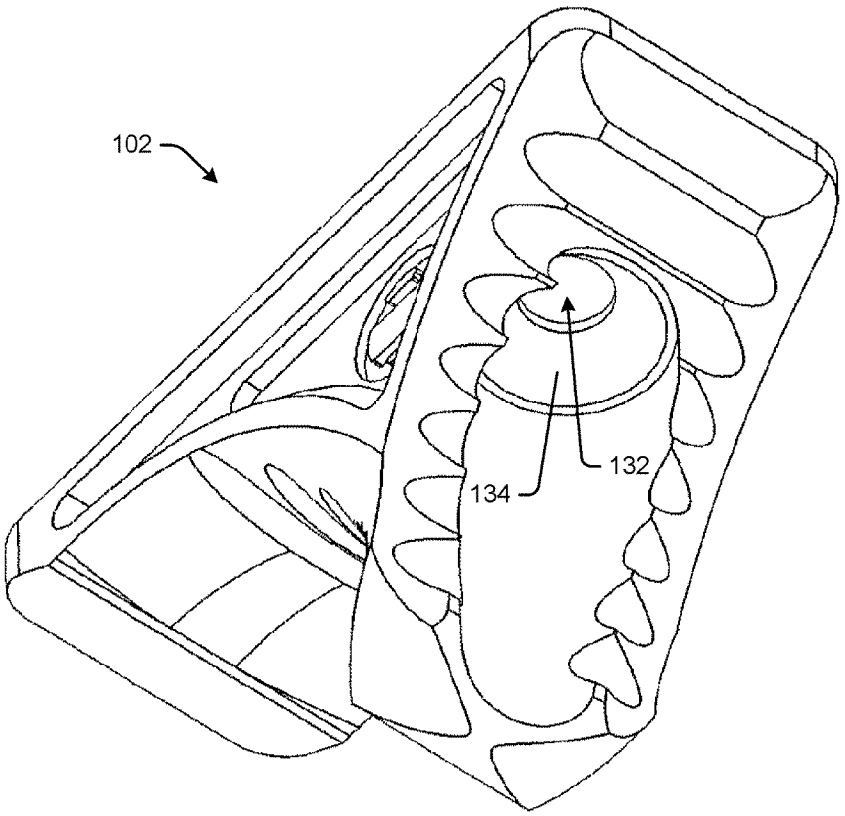
FIG. 8 depicts a lower perspective view of a firearm accessory in accordance with one or more embodiments of the disclosure.
Figure 9:
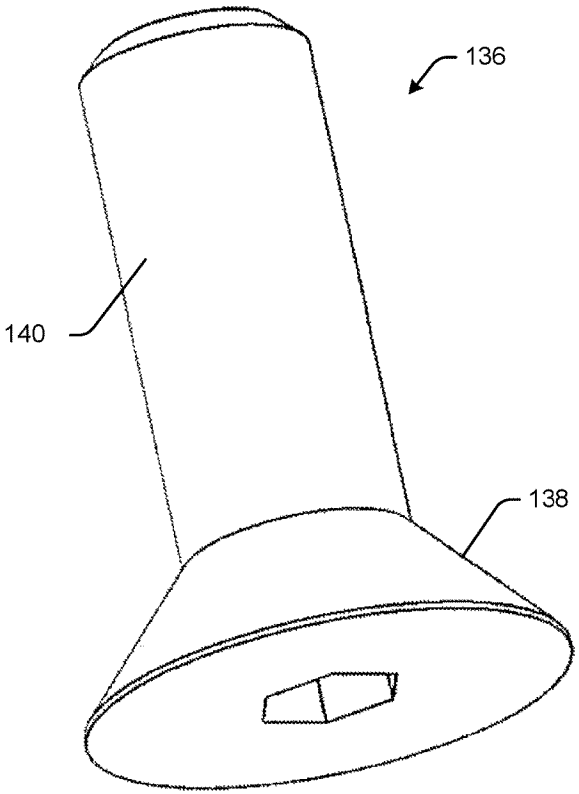
FIG. 9 depicts an upper perspective view of a fastener in accordance with one or more embodiments of the disclosure.

As depicted in FIGS. 5 and 8, the firearm accessory 102 also may include an aperture 132 therethrough. In some instances, the aperture 132 in the firearm accessory 102 may include an inner taper 134. As depicted in FIGS. 6, 7, and 9, a fastener 136 may be positionable through the aperture 132 in the firearm accessory 102, the aperture 124 in the main body 114, and the slot 110 in the first rail system 104 or the slot 112 in the second rail system 106 depending on which rail system the firearm accessory 102 is to be attached. In some instances, the fastener 136 may include a tapered portion 138 that corresponds to the inner taper 134 of the aperture 132 in the firearm accessory 102. The fastener 136 also may include external threads 140. In one example, the fastener 136 may be a countersunk head cap screw. The fastener 136 may be any suitable size, shape, or configuration.

Figure 10:
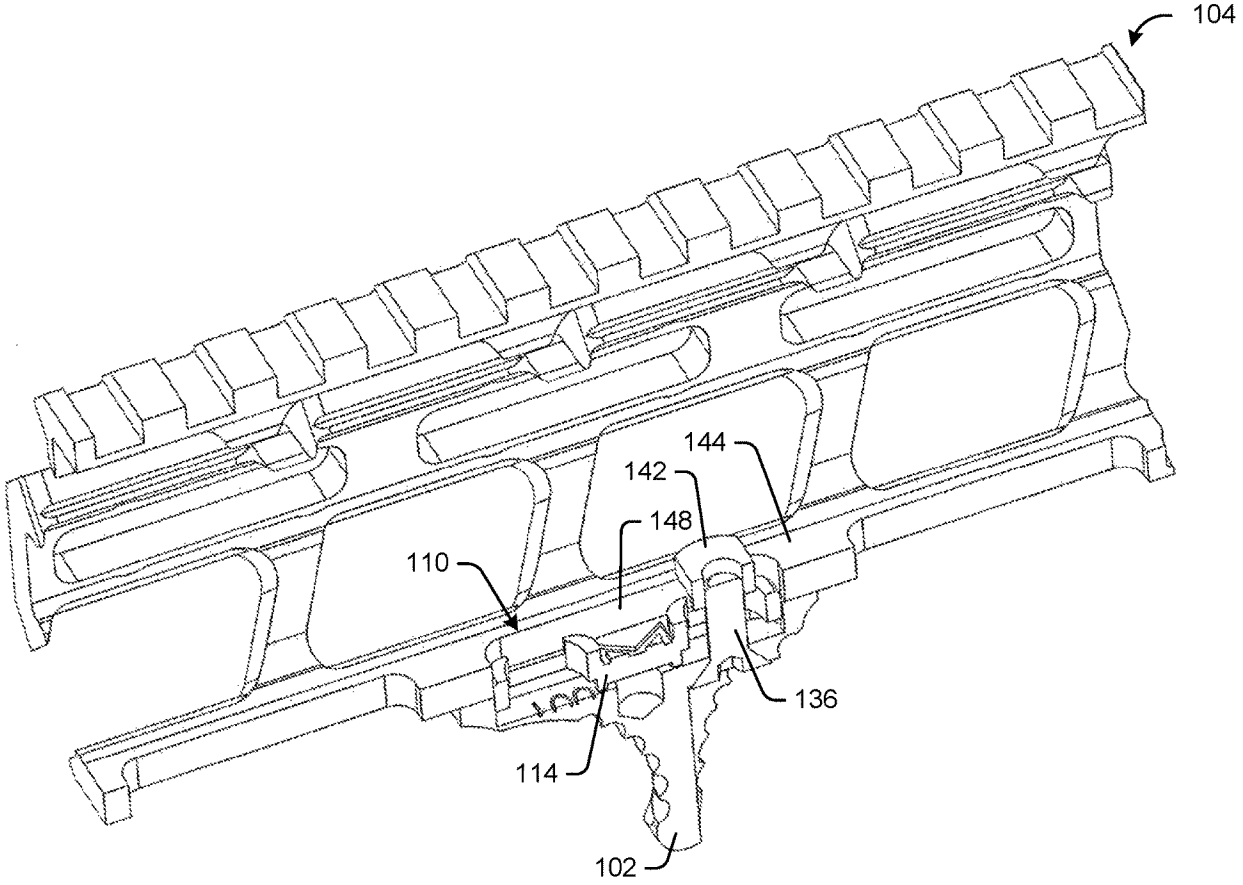
FIG. 10 depicts an upper perspective cross-sectional view of a rail attachment assembly in accordance with one or more embodiments of the disclosure.
Figure 11:
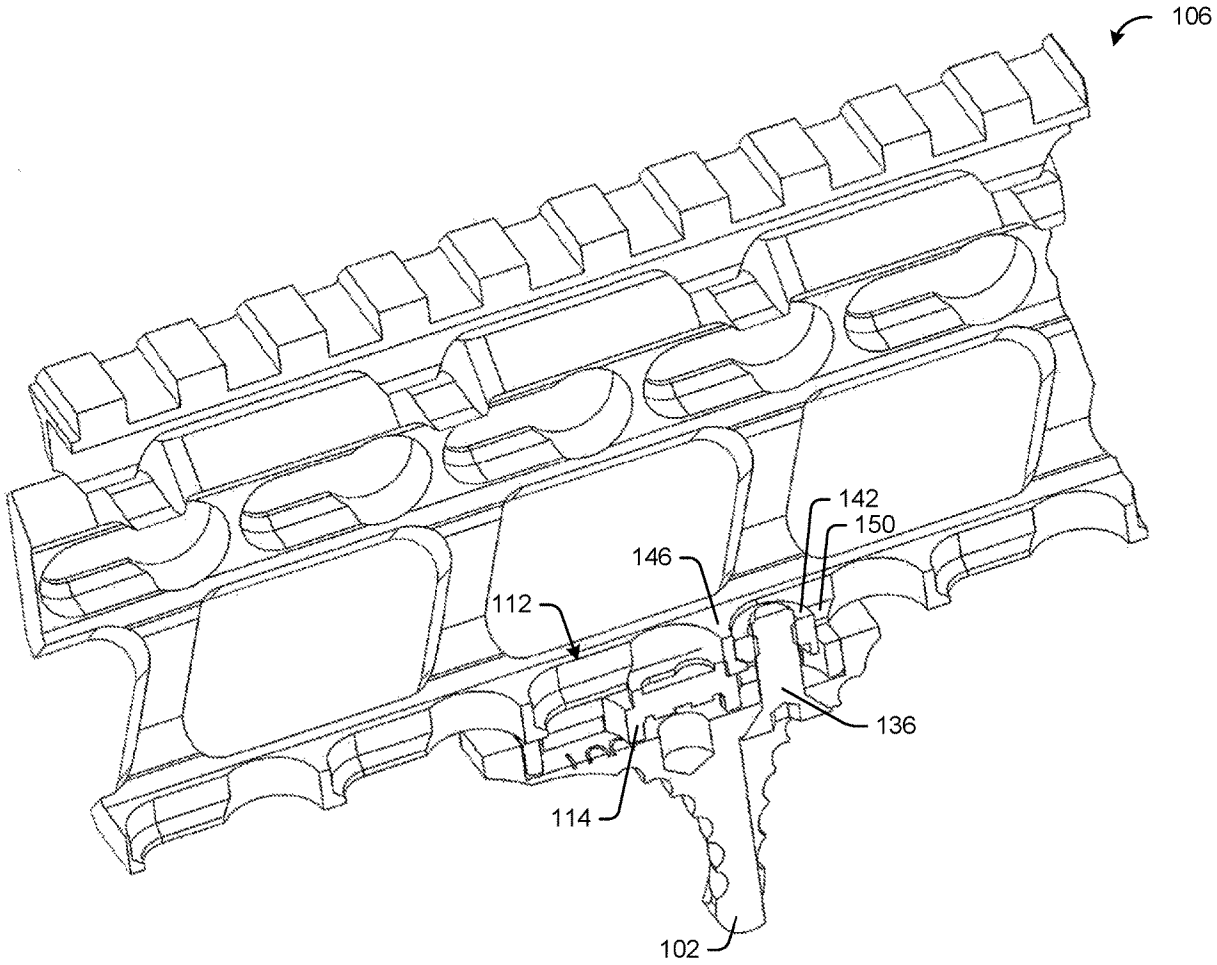
FIG. 11 depicts an upper perspective cross-sectional view of a rail attachment assembly in accordance with one or more embodiments of the disclosure.

As depicted in FIGS. 10 and 11, a nut 142 may be attachable to the fastener 136 to secure the firearm accessory 102 to the first rail system 104 or the second rail system 106. For example, the nut 142 may be positionable on an inner side 144 of the slot 110 in the first rail system 104 or an inner side 146 of the slot 112 in the second rail system 106 opposite the main body 114. In this manner, a lip 148 of the slot 110 in the first rail system 104 or a lip 150 of the slot 112 in the second rail system 106 may be captured between the nut 142 and the main body 114. In some instances, the nut 142 may be at least partially disposed within the slot 110 in the first rail system 104 or the slot 112 in the second rail system 106.

Figure 12:
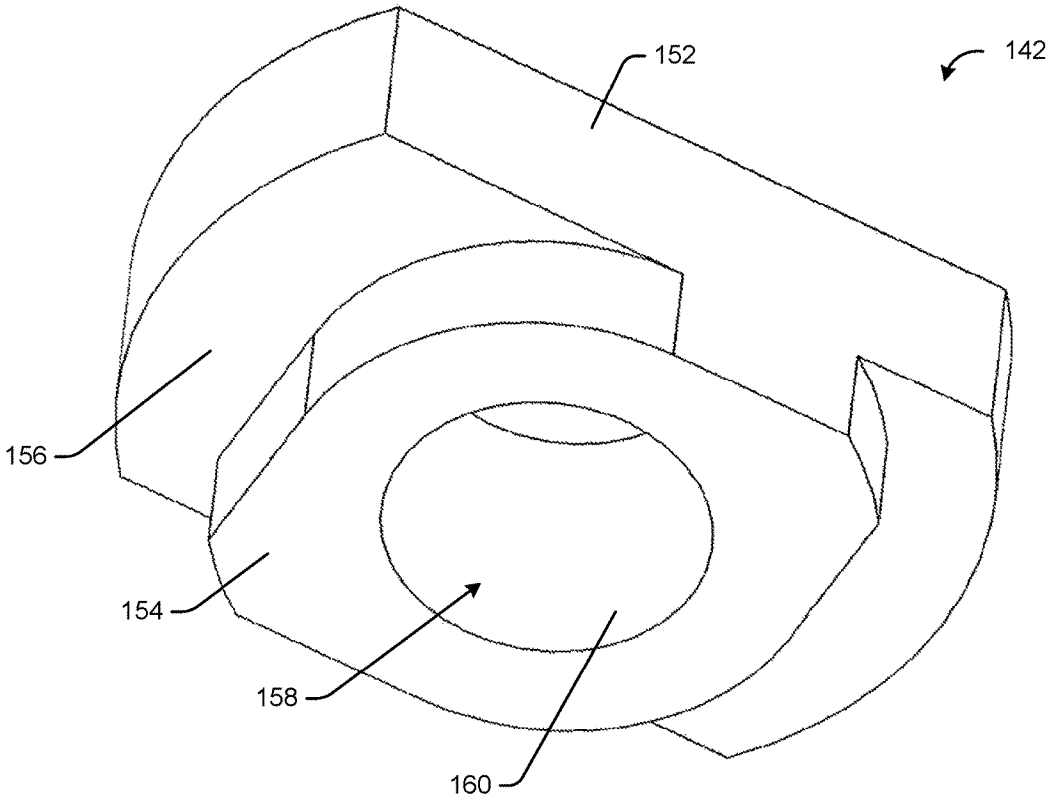
FIG. 12 depicts a lower perspective view of a nut in accordance with one or more embodiments of the disclosure.
Figure 13:
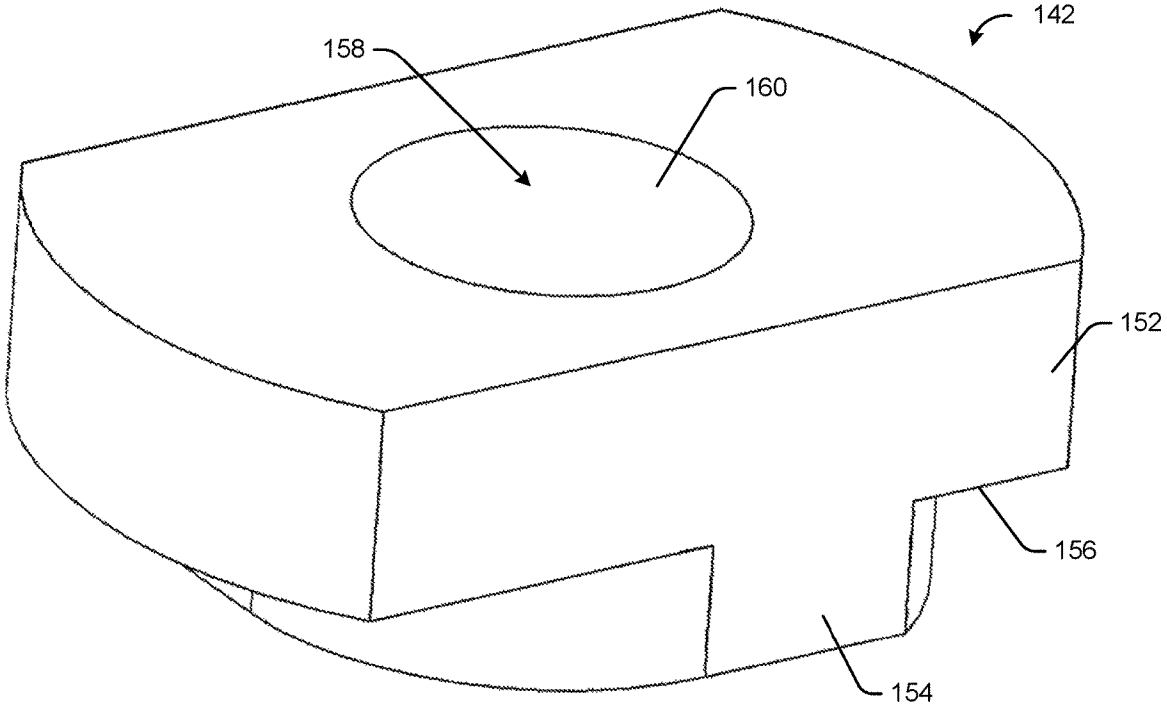
FIG. 13 depicts an upper perspective view of a nut in accordance with one or more embodiments of the disclosure.

FIGS. 12 and 13 depict an embodiment of the nut 142 used in conjunction with the first rail assembly 104. In this embodiment, the nut 142 comprises a body 152, a protrusion 154 extending from the body 152, a lip 156 formed between the body 152 and the protrusion 154, a hole 158, and internal threads 160. The nut 142 may be any suitable size, shape, or configuration.

Figure 14:
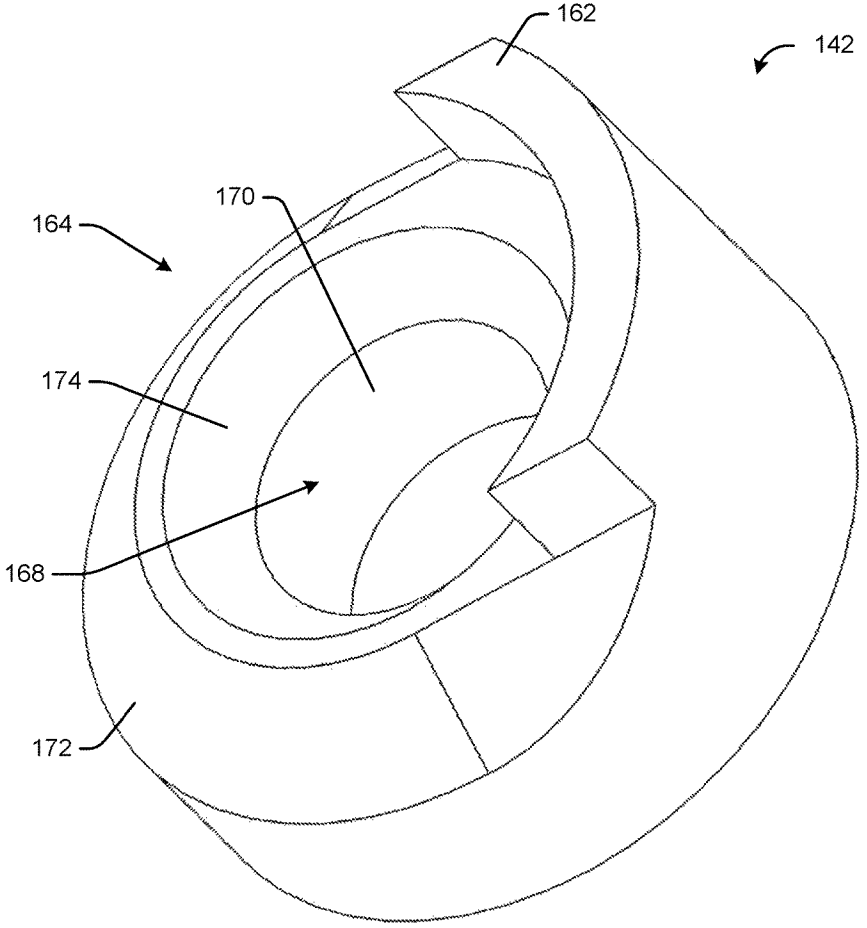
FIG. 14 depicts a lower perspective view of a nut in accordance with one or more embodiments of the disclosure.
Figure 15:
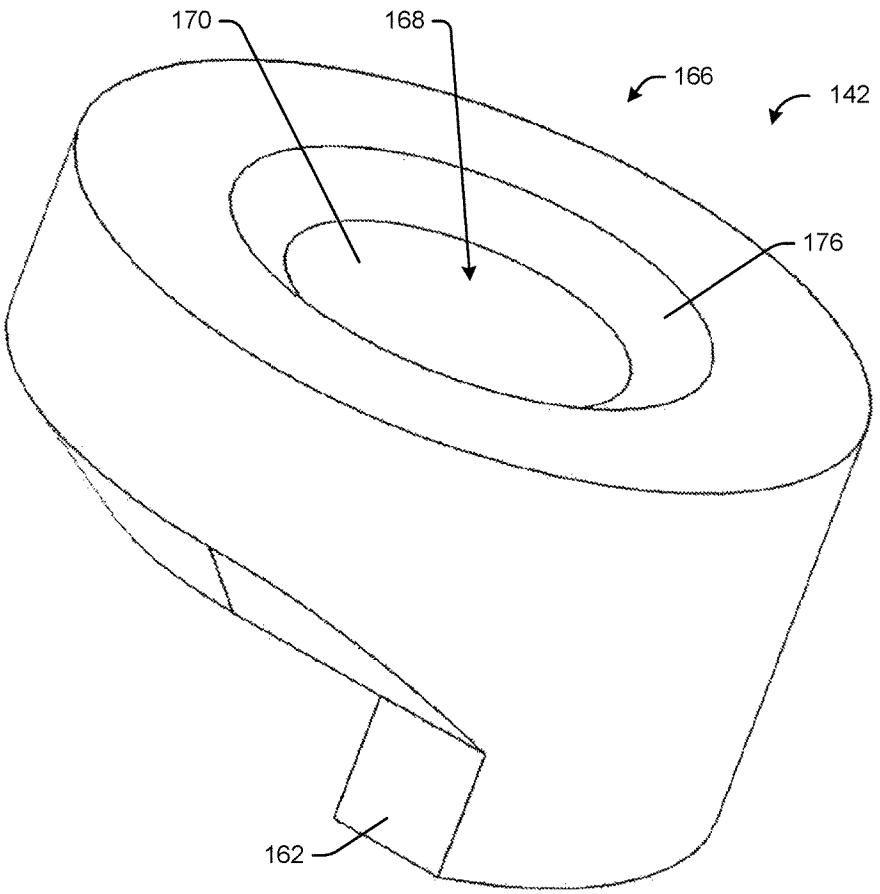
FIG. 15 depicts an upper perspective view of a nut in accordance with one or more embodiments of the disclosure.

FIGS. 14 and 15 depict an embodiment of the nut 142 used in conjunction with the second rail assembly 106. In this embodiment, the nut 142 comprises a protrusion 162, a top surface 164, a bottom surface 166, a hole 168, and internal threads 170. In some instances, the protrusion 162 is arcuate. The top surface 164 comprises an outer taper 172. The top surface 164 also comprises an upper inner taper 174 about the hole 168. The bottom surface 166 comprises a lower inner taper 176 about the hole 168. The nut 142 may be any suitable size, shape, or configuration.

FIGS. 1, 6, and 10 depict the firearm accessory 102 attached to the first rail system 104. The protrusions 118 on the first side 116 of the main body 114 are positioned within the slot 110 of the first rail system 104. The protrusions 118 at least partially engage the perimeter and corners of the slot 110. The protrusion 122 on the second side 120 of the main body 114 is disposed within the cavity 126. The fastener 136 is disposed through the aperture 132 in the firearm accessory 102, the aperture 124 in the main body 114, and the slot 110 in the first rail system 104. The nut 142 is attached to the fastener 136 to secure the firearm accessory 102 to the first rail system 104. For example, the nut 142 is positioned on an inner side 144 of the slot 110 in the first rail system 104 opposite the main body 114 such that a lip 148 of the slot 110 in the first rail system 104 is captured between the nut 142 and the main body 114.

FIGS. 2, 7, and 11 depict the firearm accessory 102 attached to the second rail system 106. The protrusion 122 on the second side 120 of the main body 114 is positioned within one of the slots 112 in the second rail system 106. The protrusion 122 at least partially engages the perimeter of the slot 112. For example, the protrusion 122 on the second side 120 of the main body 114 is disposed within a circular portion 178 of the keyhole. The protrusions 118 on the first side 116 of the main body 114 are disposed within the cavity 126. The fastener 136 is disposed through the aperture 132 in the firearm accessory 102, the aperture 124 in the main body 114, and an elongated portion 180 of an adjacent slot 112 in the second rail system 106. The nut 142 is attached to the fastener 136 to secure the firearm accessory 102 to the second rail system 106. For example, the nut 142 is positioned on an inner side 146 of the slot 112 in the second rail system 106 opposite the main body 114 such that a lip 150 of the slot 112 in the second rail system 106 is captured between the nut 142 and the main body 114. The fastener 136 and the nut 142 are positioned within the elongated portion 180 of a keyhole adjacent to a keyhole the protrusion 122 is disposed within.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An assembly for attaching a firearm accessory to a first rail system or a second rail system, the assembly comprising:

a main body comprising a first side having a protrusion configured to mate with a slot in the first rail system, a second side having a protrusion configured to mate with a slot in the second rail system, and an aperture;

a cavity in the firearm accessory configured to mate with the protrusion on the first side of the main body or the protrusion on the second side of the main body;

an aperture through the firearm accessory;

a fastener positionable through the aperture in the firearm accessory, the aperture in the main body, and the slot in the first rail system or the slot in the second rail system; and a nut attachable to the fastener to secure the firearm accessory to the first rail system or the second rail system.

2. The assembly of claim 1, wherein the size and shape of the slot in the first rail system is different from the size and shape of the slot in the second rail system.

3. The assembly of claim 1, wherein the size and shape of the protrusion on the first side of the main body is different from the size and shape of the protrusion on the second side of the main body.

4. The assembly of claim 1, wherein the slot in the first rail system comprises an elongated slot and the slot in the second rail system is a keyhole.

5. The assembly of claim 4, wherein the protrusion on the second side of the main body is positionable within a circular portion of the keyhole in the second rail system, and the nut is positionable within an elongated portion of the keyhole in the second rail system.

6. The assembly of claim 1, wherein the first rail system comprises an M-Lok rail system and the second rail system comprises a KeyMod rail system.

7. The assembly of claim 1, wherein the nut is positionable on a side of the slot in the first rail system or a side of the slot in the second rail system opposite the main body.

8. The assembly of claim 1, wherein a lip of the slot in the first rail system or a lip of the slot in the second rail system is captured between the nut and the main body.

9. The assembly of claim 1, wherein the protrusion on the first side of the main body comprises a plurality of protrusion.

10. The assembly of claim 1, wherein the first side of the main body comprises a references marking indicating that it is used with the first rail system and the second side of the main body comprises a reference mark indicating it is used with the second rail system.

11. The assembly of claim 1, wherein the nut comprises a protrusion, a top surface, a bottom surface, a hole, and internal threads, wherein the top surface comprises an outer taper, wherein the top surface comprises an upper inner taper about the hole, wherein the bottom surface comprises a lower inner taper about the hole.

12. The assembly of claim 11, wherein the protrusion is arcuate.

13. The assembly of claim 1, wherein the aperture in the firearm accessory comprises an inner taper.

14. The system of claim 13, wherein the fastener comprises a tapered portion that corresponds to the inner taper of the aperture in the firearm accessory.

15. The system of claim 1, wherein the fastener comprises external threads.

16. The system of claim 1, wherein the fastener comprises a countersunk head cap screw.

17. The system of claim 1, wherein the nut comprises a body, a protrusion extending from the body, a lip formed between the body and the protrusion, a hole, and internal threads.

18. A method for attaching a firearm accessory to a first rail system or a second rail system, the method comprising:

providing a main body comprising a first side having a protrusion configured to mate with a slot in the first rail system, a second side having a protrusion configured to mate with a slot in the second rail system, and an aperture;

providing a cavity in the firearm accessory configured to mate with the protrusion on the first side of the main body or the protrusion on the second side of the main body;

providing an aperture through the firearm accessory;

providing a fastener positionable through the aperture in the firearm accessory, the aperture in the main body, and the slot in the first rail system or the slot in the second rail system; and providing a nut attachable to the fastener to secure the firearm accessory to the first rail system or the second rail system.

* * * * *